US011822271B2

(12) United States Patent
Maruyama

(10) Patent No.: US 11,822,271 B2
(45) Date of Patent: Nov. 21, 2023

(54) HEATING UNIT FOR AN IMAGE FORMING APPARATUS

(71) Applicant: Brother Kogyo Kabushiki Kaisha, Nagoya (JP)

(72) Inventor: Yasuhiro Maruyama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/575,849

(22) Filed: Jan. 14, 2022

(65) Prior Publication Data

US 2022/0229387 A1 Jul. 21, 2022

(30) Foreign Application Priority Data

Jan. 15, 2021 (JP) ..... 2021-004689

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 2215/2035
See application file for complete search history.

(56) References Cited

U.S. PATENT DOCUMENTS 10,268,146 B2 * 4/2019 Sato ..... G03G 15/2017
10,444,682 B2 * 10/2019 Nakamoto ..... G03G 15/2039
10,488,795 B2 * 11/2019 Tanaka ..... G03G 15/2053
2005/0006370 A1 * 1/2005 Suzumi ..... G03G 15/2064 219/216
2014/0138372 A1 * 5/2014 Ogura ..... G03G 15/2042 399/329
2015/0139706 A1 5/2015 Fujiwara et al.
2015/0139708 A1 * 5/2015 Shimura ..... G03G 15/2053 399/329
2015/0227091 A1 * 8/2015 Ando ..... G03G 15/2053 399/33
2016/0216659 A1 * 7/2016 Ikegami ..... G03G 15/2053
2018/0181037 A1 * 6/2018 Kataoka ..... G03G 15/2053
2020/0033774 A1 1/2020 Shinji et al.
(Continued)

FOREIGN PATENT DOCUMENTS

CN 108983572 A * 12/2018 ..... G03G 15/2017
JP 2014-123100 A 7/2014
(Continued)

*Primary Examiner* — Arlene Heredia
(74) *Attorney, Agent, or Firm* — BURR PATENT LAW, PLLC

(57) ABSTRACT

A heating unit includes a heater including a substrate and a resistance heating element, a temperature sensor, an endless belt, a holder, a first heat conductive sheet located between the heater and the holder, and a second heat conductive sheet which is smaller than the first heat conductive heat member. The first heat conductive sheet includes a first heater-side surface which is in contact with a back surface of the heater and a first opposite surface. The first heat conductive sheet has a heat conductivity higher than that of the substrate. The second heat conductive sheet includes a second heater-side surface which is in contact with the first opposite surface and a second opposite surface. The temperature sensor is in contact with the second opposite surface of the second heat conductive sheet.

18 Claims, 9 Drawing Sheets

(56) References Cited

U.S. PATENT DOCUMENTS

| | | | | |
|---|---|---|---|---|
| 2020/0401067 | A1* | 12/2020 | Samei | G03G 15/2053 |
| 2022/0163910 | A1* | 5/2022 | Murakami | G03G 15/2053 |
| 2022/0236676 | A1* | 7/2022 | Ubagai | G03G 15/2053 |

FOREIGN PATENT DOCUMENTS

| | | | | | |
|---|---|---|---|---|---|
| JP | 2015-099190 | A | | 5/2015 | |
| JP | 2016-029512 | A | | 3/2016 | |
| JP | 2019074606 | A | * | 5/2019 | G03G 15/2028 |
| JP | 2020-016825 | A | | 1/2020 | |

* cited by examiner

HEATING UNIT FOR AN IMAGE FORMING APPARATUS

CROSS REFERENCE TO RELATED APPLICATION

The present application claims priority from Japanese Patent Application No. 2021-004689, which was filed on Jan. 15, 2021, the disclosure of which is herein incorporated by reference in its entirety.

BACKGROUND

The following disclosure relates to a heating unit used for a fixing device of an electrophotographic type image forming apparatus or the like.

In the past, there has been known a fixing device in which a rotating belt is interposed between a ceramic heater and a pressure roller. In the fixing device, the ceramic heater includes a substrate and a resistance heating element, in which one sheet-shaped heat conductive member is disposed so as to be in contact with a back surface located on an opposite side of a nip surface which is in contact with the belt. A temperature detecting member is in contact with the heater.

SUMMARY

Incidentally, in a case where the heater is configured such that the resistance heating element is provided on the substrate, a temperature difference occurs between a portion of the heater near to the resistance heating element and a portion of the heater apart from the resistance heating element. Accordingly, when the temperature detecting member is brought into contact with said one heat conductive member disposed between the temperature detecting member and the heater as in the related-art technique, it may be difficult to detect an accurate temperature by the temperature detecting member due to unevenness in the heat conductive member in temperature caused by disposition of the resistance heating element.

In view of the above, an object of the present disclosure is to detect the accurate temperature by the temperature detecting member.

In one aspect of the disclosure, a heating unit includes a heater including a substrate and a resistance heating element provided on the substrate, a temperature sensor configured to detect a temperature of the heater, an endless belt configured to rotate around the heater, a holder supporting the heater, a first heat conductive member located between the heater and the holder, the first heat conductive member including a first heater-side surface which is in contact with a back surface of the heater and a first opposite surface located on an opposite side of the first heater-side surface, the first heat conductive member having a heat conductivity higher than that of the substrate, and a second heat conductive member which is smaller than the first heat conductive heat member when viewed in an orthogonal direction orthogonal to the first opposite surface, the second heat conductive member including a second heater-side surface which is in contact with the first opposite surface and a second opposite surface located on an opposite side of the second heater-side surface. The temperature sensor is in contact with the second opposite surface of the second heat conductive member.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
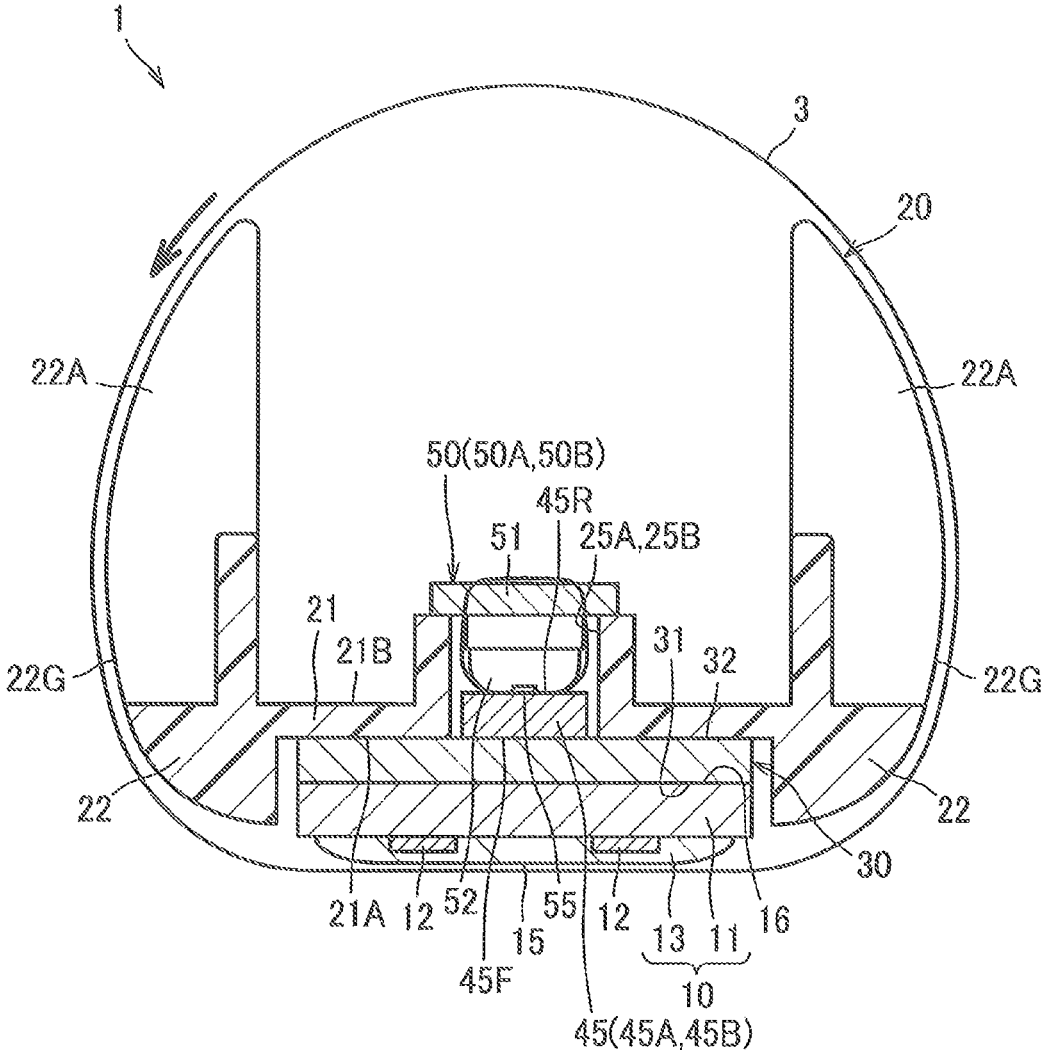
FIG. 1 is a cross-sectional view of a heating unit at a position of a thermistor.

A heating unit 1 according to an embodiment is used for a fixing device of an image forming apparatus, or a device that transfers foil by heat, and the like. As illustrated in FIG. 1, the heating unit 1 includes a belt 3, a heater 10, a holder 20, a first heat conductive member 30, second heat conductive members 45, 46 (see FIG. 4), a thermistor 50 as an example of a temperature sensor, and an energization interrupting member 60 as another example of the temperature sensor (see FIG. 4).

The belt 3 is an endless belt, which is made of metal or resin. The belt 3 rotates around the heater 10 while being guided by the holder 20. The belt 3 has an outer circumferential surface and an inner circumferential surface. The outer circumferential surface comes into contact with a sheet to be heated. The inner circumferential surface is in contact with the heater 10.

Figure 2A:
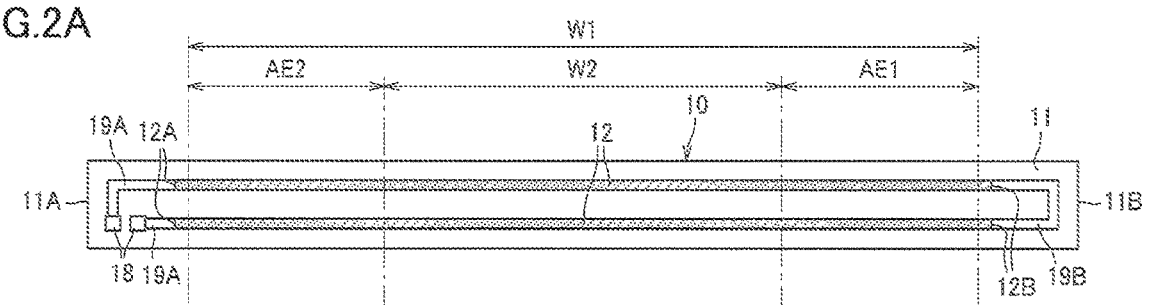
FIG. 2A is a view illustrating a surface on which resistance heating elements of a heater are disposed.
Figure 2B:
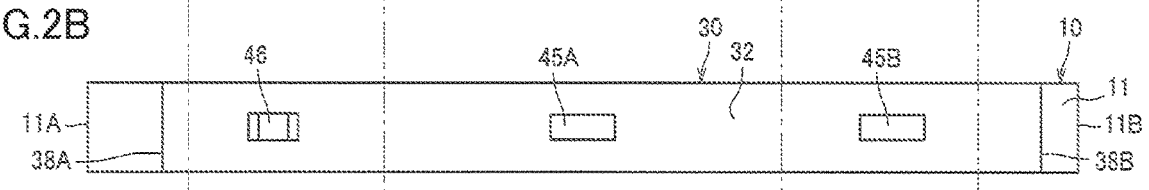
FIG. 2B is a view of the heater, a first heat conductive member, and second heat conductive members viewed from a back side of the heater.

The heater 10 includes a substrate 11, resistance heating elements 12 provided on the substrate 11, and a cover 13. The substrate 11 is formed of a long rectangular plate made of ceramic. The heater 10 is a so-called ceramic heater. The resistance heating elements 12 are formed on one surface of the substrate 11 by printing. As illustrated in FIG. 2A, two resistance heating elements 12 are provided in the present embodiment. The two resistance heating elements 12 are respectively disposed so as to extend in a longitudinal direction of the heater 10 (hereinafter the longitudinal direction of the heater 10 is referred to merely as a "longitudinal direction") and so as to be spaced apart from each other in parallel in a short-side direction, of the heater 10, orthogonal to the longitudinal direction. A conducting wire 19A is connected to one end 12A of each of the resistance heating elements 12, and a terminal 18 for supplying power is provided at an end portion of the conducting wire 19A of each of the resistance heating elements 12. The other ends 12B of the resistance heating elements 12 are connected to each other by a conducting wire 19B. The number of resistance heating elements 12 is not particularly limited. It is noted that the resistance heating elements may be configured such that a resistance heating element in which a heat generation amount at the center in the longitudinal direction is higher than a heat generation amount at end portions in the longitudinal direction and a resistance heating element in which the heat generation amount at end portions in the longitudinal direction is higher than the heat generation amount at the center in the longitudinal direction are provided, and such that a heat generation distribution in the longitudinal direction is regulated by individually controlling each of the resistance heating elements.

The cover 13 covers the resistance heating elements 12. The cover 13 is made of, for example, glass. The heater 10 includes a nip surface 15 which is in contact with the inner circumferential surface of the belt 3, and a back surface 16 located on an opposite side of the nip surface 15.

Figure 2C:
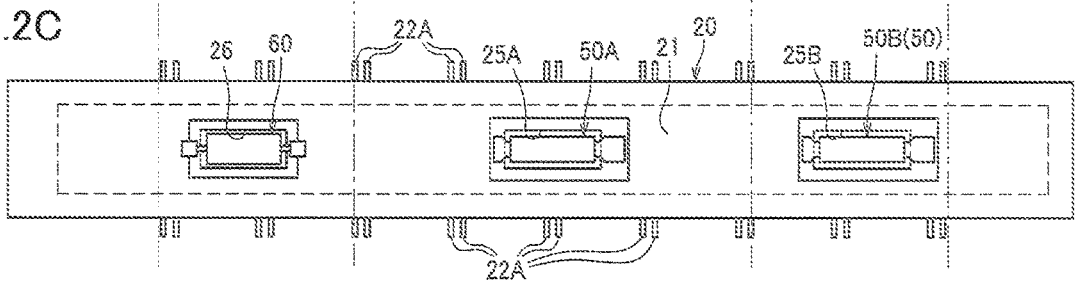
FIG. 2C is a view of a holder viewed from a side opposite to the heater.

The holder 20 is a member supporting the heater 10. The holder 20 includes a support portion 21 and guide portions 22. The support portion 21 has a plate shape corresponding to a shape of the heater 10. The support portion 21 includes a support surface 21A which is a surface facing a side on which the heater 10 is disposed and an inside surface 21B located on an opposite side of the support surface 21A. As illustrated in FIG. 2C, the support portion 21 has holder openings 25A, 25B, and 26 piercing through the support portion 21. The holder opening 25A is disposed at a center of the support portion 21 in the longitudinal direction, and has a long rectangular shape in the longitudinal direction. The holder opening 26 is disposed at one end portion of the support portion 21 in the longitudinal direction, and has a long rectangular shape in the longitudinal direction. The holder opening 25B is disposed at the other end portion of the support portion 21 in the longitudinal direction, and has a long rectangular shape in the longitudinal direction.

The thermistor 50 includes two thermistors which are a first thermistor 50A and a second thermistor 50B. The first thermistor 50A and the second thermistor 50B are the same components. The first thermistor 50A detects a temperature at a center of the heater 10 in the longitudinal direction of the heater 10. The first thermistor 50A is used for controlling the temperature of the heater 10 such that the temperature of the heater 10 becomes a target temperature based on the temperature detected by the first thermistor 50A. The second thermistor 50B detects the temperature of the heater 10 at a position nearer to an end of the heater 10 in the longitudinal direction than the position detected by the first thermistor 50A. The second thermistor 50B is used for detecting that the temperature is increased at the position near to the end of the heater 10. The holder opening 25A is disposed at a position corresponding to the first thermistor 50A. The first thermistor 50A and the second thermistor 50B may not be the same component. In this case, it is preferable that the first thermistor 50A is a member with higher accuracy in temperature detection than the second thermistor 50B in a temperature range during printing operation.

The energization interrupting member 60 is a member configured to interrupt energization to the resistance heating elements 12 when the heater 10 is abnormally increased in temperature. The holder opening 26 is disposed at the position corresponding to the energization interrupting member 60.

Returning to FIG. 1, the guide portions 22 are provided at both ends in a short-side direction of the support portion 21. The short-side direction is a direction orthogonal to the longitudinal direction of the support portion 21. Each of the guide portions 22 includes a guide surface 22G extending along the inner circumferential surface of the belt 3. Each of the guide portions 22 has a plurality of guide ribs 22A arranged in the longitudinal direction as illustrated in FIG. 1 and FIG. 2C.

The first heat conductive member 30 is a member configured to uniformize the temperature of the heater 10 in the longitudinal direction by conducting heat in the longitudinal direction of the heater 10. The first heat conductive member 30 is a sheet-like member, and is located between the heater 10 and the support portion 21 of the holder 20. When the sheet as a heating target is interposed between the heating unit 1 and another pressure member, the first heat conductive member 30 is interposed between the heater 10 and the support portion 21. The first heat conductive member 30 includes a first heater-side surface 31 which is in contact with the back surface 16 of the heater 10 and a first opposite surface 32 located on an opposite side of the first heater-side surface 31. The first opposite surface 32 is in contact with the support surface 21A of the support portion 21.

Figure 6:
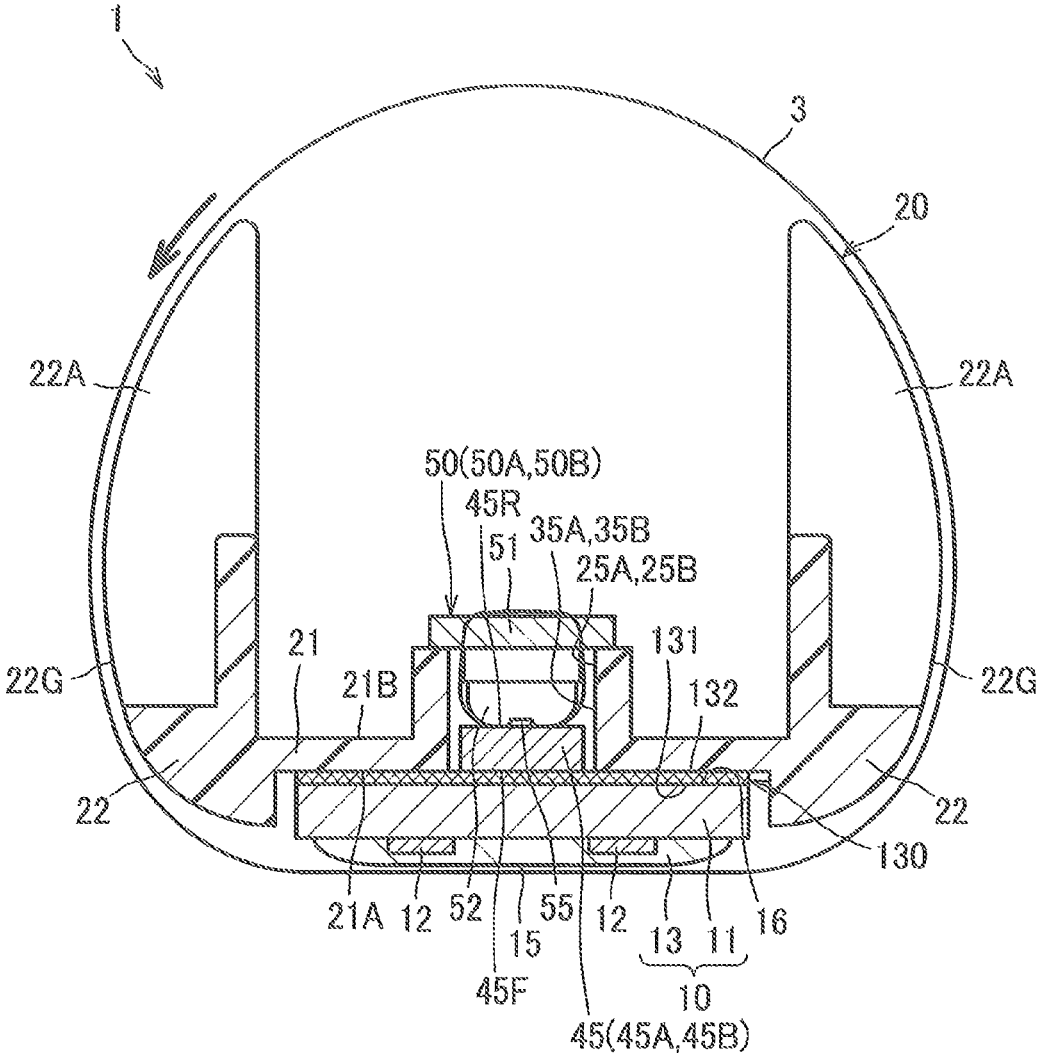
FIG. 6 is a cross-sectional view of a heating unit at the position of the thermistor in a case where the first heat conductive member is a graphite sheet.

The first heat conductive member 30 is a member in which a heat conductivity in a direction parallel to the first heater-side surface 31 (hereinafter referred to merely as a "planar direction") is higher than a heat conductivity of the substrate 11 in the planar direction. A material of the first heat conductive member 30 is not particularly limited. For example, metals such as aluminum, aluminum alloys, and copper having high heat conductivities can be adopted. The first heat conductive member 30 may be an anisotropic heat conductive member in which the heat conductivity in the planar direction is higher than a heat conductivity in a thickness direction orthogonal to the first heater-side surface 31. For example, a thin graphite sheet illustrated in FIG. 6 can be adopted as the anisotropic heat conductive member. A thickness of the first heat conductive member 30 is not particularly limited either. For example, a film-like member thinner than 0.1 mm and a plate-like member thicker than 1 mm may be adopted. It is preferable that the thickness of the first heat conductive member 30 is 0.03 mm to 3 mm.

The second heat conductive members 45, 46 are members configured to uniformize the temperature at each of portions where the second heat conductive members 45, 46 are in contact with the first heat conductive member 30 by conducting heat in the planar direction.

The second heat conductive member 45 is a sheet-like member, and includes a second heater-side surface 45F facing the heater 10 side and a second opposite surface 45R located on an opposite side of the second heater-side surface 45F. The second heater-side surface 45F is in contact with the first opposite surface 32.

Figure 4:
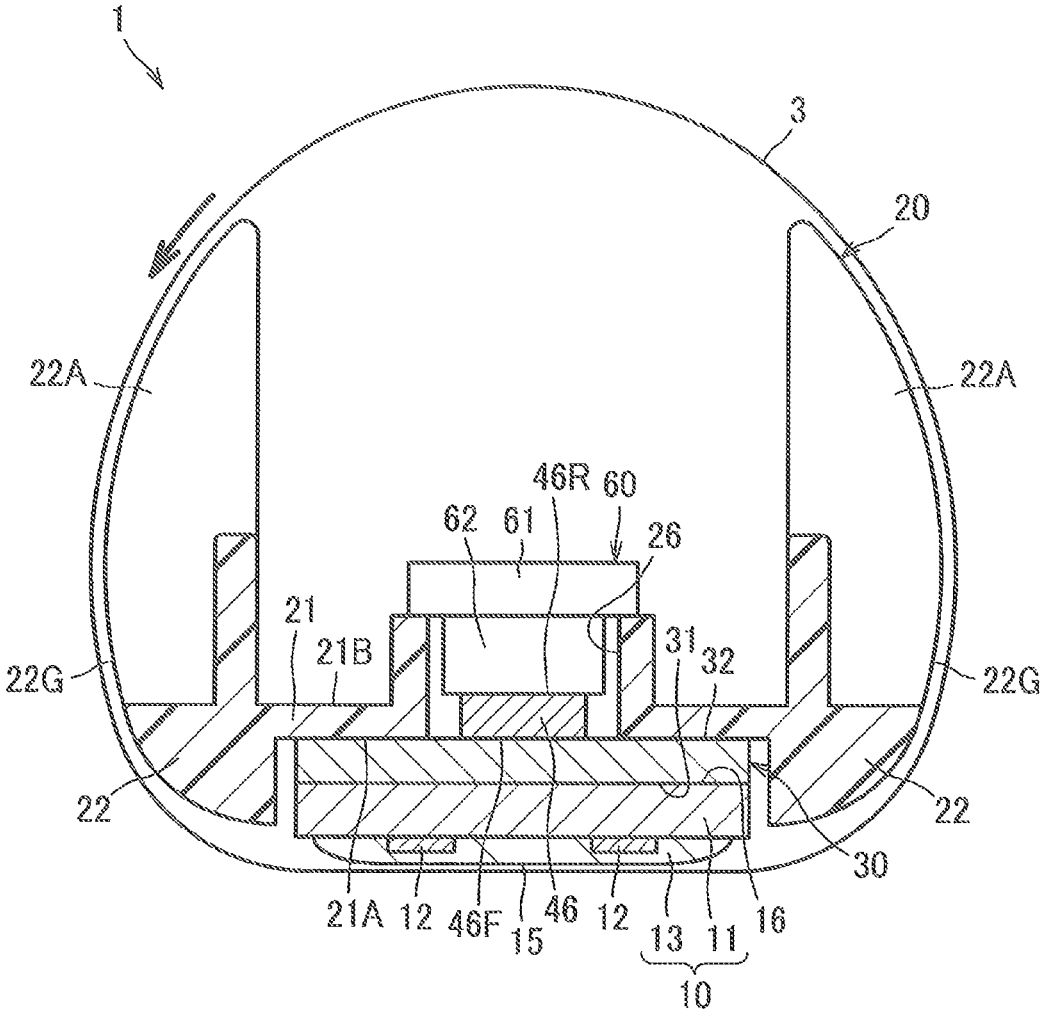
FIG. 4 is a cross-sectional view of the heating unit at a position of the energization interrupting member.

As illustrated in FIG. 4, the second heat conductive member 46 also includes a second heater-side surface 46F facing the heater 10 side and a second opposite surface 46R located on an opposite side of the second heater-side surface 46F in the same manner. The second heater-side surface 46F is in contact with the first opposite surface 32.

As illustrated in FIG. 1 and FIG. 4, second heat conductive members 45A. 45B, 46 are disposed at positions respectively corresponding to the holder openings 25A, 25B, and the holder opening 26 when viewed in an orthogonal direction orthogonal to the first opposite surface 32 of the first heat conductive member 30. The second heat conductive member 45 includes the second heat conductive member 45A and the second heat conductive member 45B. In the embodiment, the second heat conductive member 45A and the second heat conductive member 45B are the same component while disposed at positions different from each other.

In the embodiment, sizes of the second heat conductive members 45A, 45B, and 46 are smaller than a size of the first heat conductive member 30 when viewed in the orthogonal direction orthogonal to the first opposite surface 32. The relationship in which "the sizes of the second heat conductive member 45A, 45B, and 46 are smaller than the size of the first heat conductive member 30" means that, in a case where any one of the second heat conductive members 45A, 45B, and 46 overlaps the first heat conductive member 30, said any one of the second heat conductive members 45A, 45B, and 46 is entirely located inside an outline of the first heat conductive member 30 when viewed in the orthogonal direction.

The second heat conductive members 45A, 45B. 46 are members in which a heat conductivity in the planar direction is higher than the heat conductivity in the planar direction of the substrate 11. A material of each of the second heat conductive members 45A, 45B. 46 is not particularly limited. For example, metals such as aluminum, aluminum alloys, and copper having high heat conductivities can be adopted. A thickness of each of the second heat conductive members 45A, 45B, 46 is not particularly limited either. For example, a film-like member thinner than 0.1 mm and a plate-like member thicker than 1 mm may be adopted as the second heat conductive members 45A, 45B, 46. It is preferable that the thickness of each of the second heat conductive members 45, 46 is 0.03 mm to 3 mm.

Dimensions of the second heat conductive members 45A, 45B, 46 in the short-side direction orthogonal to the longitudinal direction are larger than a dimension of the resistance heating element 12 in the short-side direction. Then, the second heat conductive members 45A, 45B, 46 are located between the two resistance heating elements 12 in the short-side direction.

Figure 5A:
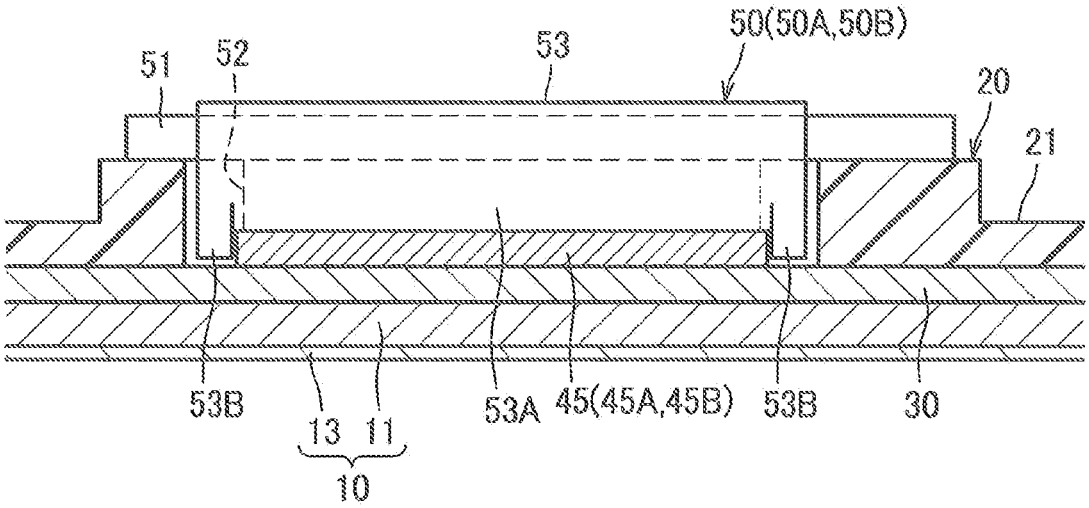
FIG. 5A is a cross-sectional view of the heating unit along a longitudinal direction for explaining positioning of the second heat conductive member and the thermistor.
Figure 5B:
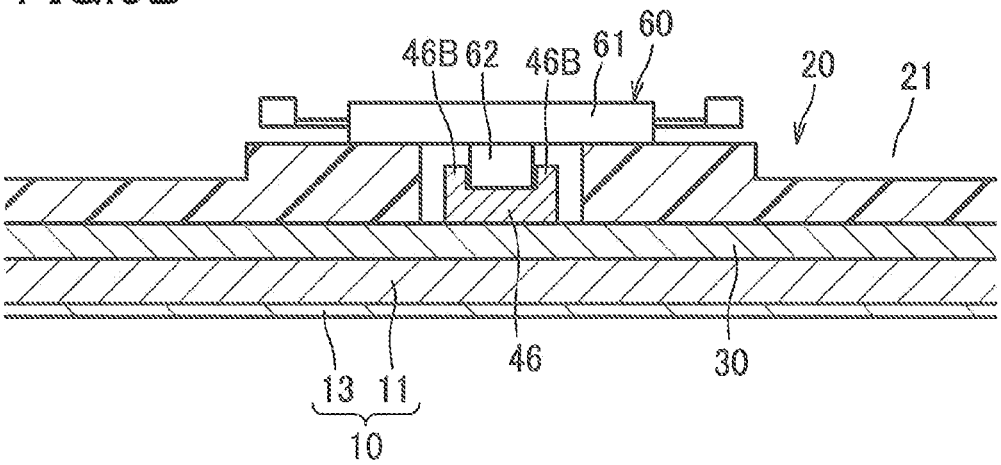
FIG. 5B is a cross-sectional view of the heating unit along the longitudinal direction for explaining positioning of the second heat conductive member and the energization interrupting member.

The second heat conductive member 46 has protruding portions 46B, each of which is an example of a second protruding portion, protruding toward the energization interrupting member 60 in the thickness direction as illustrated in FIG. 5B. The protruding portions 46B protrude from end portions in the longitudinal direction of the second heat conductive member 46.

Figure 3A:
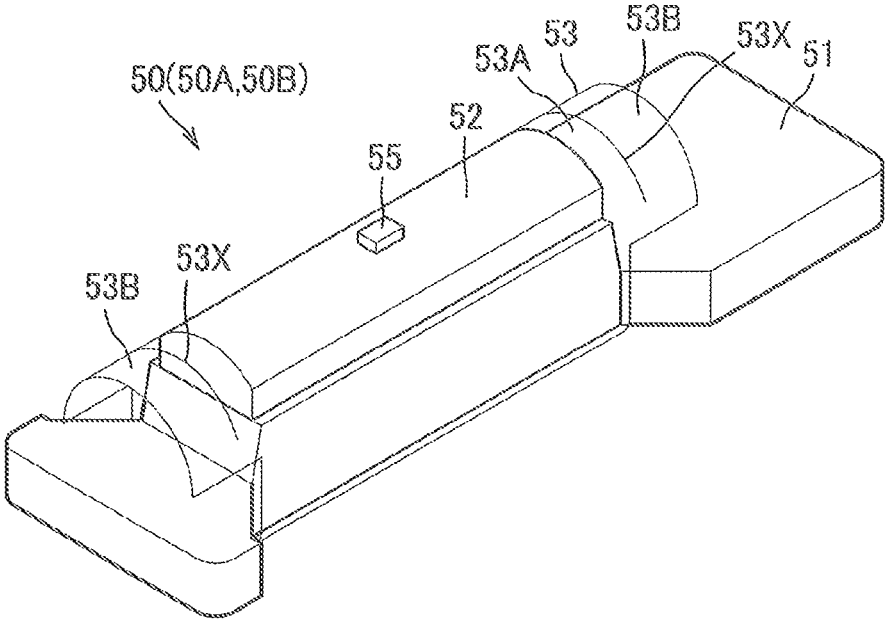
FIG. 3A is a perspective view of the thermistor.

As illustrated in FIG. 3A, the thermistor 50 (50A, 50B) includes a support plate 51, an urging member 52, a film 53, and a temperature detecting element 55. The urging member 52 is a spongy member having elasticity, and the urging member 52 is supported by the support plate 51. The urging member 52 has a D-shape in cross section. The temperature detecting element 55 is disposed so as to be located at a most protruding portion in the urging member 52, and the temperature detecting element 55 is connected to not-illustrated wiring. The film 53 is disposed such that the temperature detecting element 55 is located at the most protruding portion in the urging member 52, and the film 53 is mounted to the support plate 51 so as to be wound around the urging portion 52 and the support plate 51.

As illustrated in FIG. 3A, the film 53 has slits 53X extending in a direction orthogonal to the longitudinal direction at both end portions of the film 53 in the longitudinal direction. Accordingly, the film 53 includes a central portion 53A located at the center of the film 53 in the longitudinal direction and being in contact with the urging portion 52, and protruding portions 53B, each of which is an example of a first protruding portion, positioned at both end portions of the film 53 in the longitudinal direction. The protruding portions 53B are portions, as illustrated in FIG. 5A, protruding relatively to the central portion 53A by the urging member 52 which is pushed and deformed when the thermistor 50 is mounted to the holder 20 and the thermistor 50 is pushed onto the second heat conductive member 45A, 45B. The second heat conductive member 45A, 45B are positioned with respect to the thermistor 50 in a state in which both ends of the second heat conductive member 45A, 45B in the longitudinal direction are engaged with the protruding portions 53B.

Figure 3B:
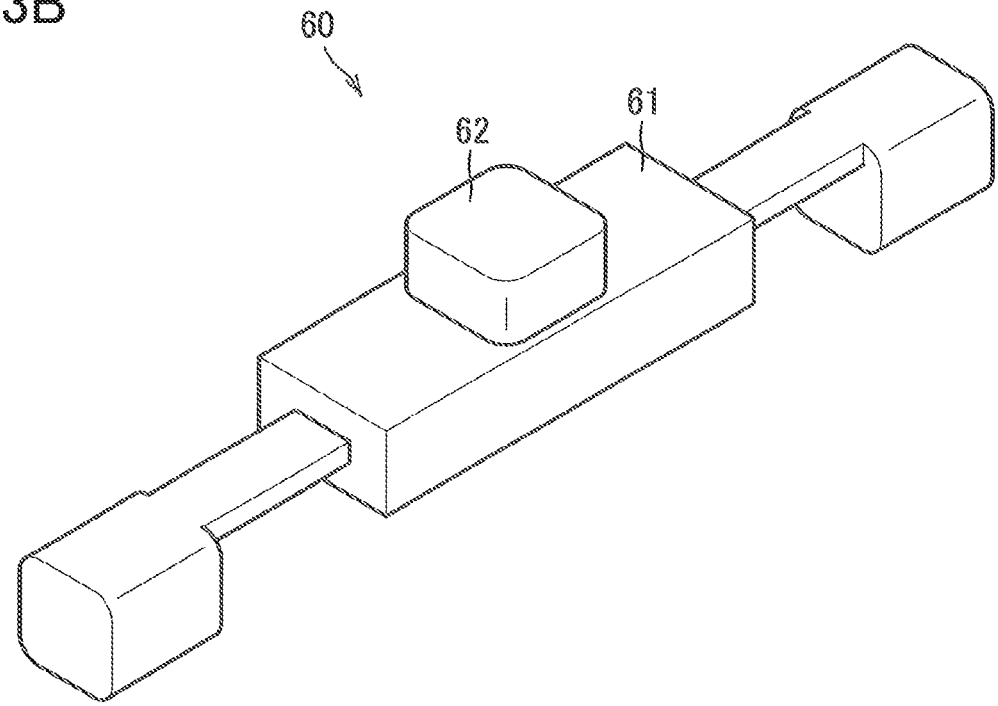
FIG. 3B is a perspective view of an energization interrupting member.

As illustrated in FIG. 3B, the energization interrupting member 60 is a thermostat having an interrupting mechanism formed of bimetal and located inside the thermostat, and the energization interrupting member 60 includes a case 61 accommodating the interrupting mechanism and a detector 62 protruding from the case 61 and configured to detect a temperature. As illustrated in FIG. 5B, the second heat conductive member 46 is positioned with respect to the energization interrupting member 60 in a state in which the protruding portions 46B are engaged with both ends of the detector 62 in the longitudinal direction.

As illustrated in FIG. 1, the first thermistor 50A is configured such that a portion protruding from the support plate 51 enters an inside of the holder opening 25A, and the portion protruding from the support plate 51 is in contact with the second opposite surface 45R of the second heat conductive member 45A through the holder opening 25A. The urging member 52 of the first thermistor 50A is pushed and deformed, and the temperature detecting element 55 is pushed onto the second opposite surface 45R of the second heat conductive member 45A. A configuration in which the second thermistor 50B is in contact with the second opposite surface 45R is the same as the configuration in which the first thermistor 50A is in contact with the second opposite surface 45R; therefore, explanation of the second thermistor 50B is dispensed with.

As illustrated in FIG. 4, the energization interrupting member 60 is configured such that the detector 62 protruding from the case 61 enters the holder opening 26, and the detector 62 is in contact with the second opposite surface 46R of the second heat conductive member 46 through the holder opening 26.

When viewed in the orthogonal direction orthogonal to the first opposite surface 32, a dimension of the second heat conductive member 45 in the longitudinal direction is equal to or less than twice a dimension of a contact portion on the second opposite surface 45R, in the longitudinal direction, with which the thermistor 50 is in contact. That is, the contact portion between the thermistor 50 and the second opposite surface 45R is a portion on the second opposite surface 45R which is produced by contact of the thermistor 50 with the second opposite surface 45R. By the contact of the thermistor 50 with the second opposite surface 45R, a contact area on the second opposite surface 45R is produced, and the dimension of the contact portion is defined by an outline of the contact area. That is, the dimension of the contact portion in the longitudinal direction is defined by the outline of the contact area in the longitudinal direction. Moreover, a dimension of the second heat conductive member 45 in a short-side direction orthogonal to the orthogonal direction and the longitudinal direction is equal to or less than a dimension of the contact portion of the second opposite surface 45R, in the short-side direction, with which the thermistor 50 is in contact. That is, the dimension of the contact portion in the short-side direction is defined by the outline of the contact area in the short-side direction. It is preferable that the dimension of the second heat conductive member 45 in the short-side direction is greater than a width of one resistance heating element 12 in the short-side direction, and it is preferable that the dimension of the second heat conductive member 45 in the short-side direction is greater than a distance between the adjacent two resistance heating element 12 in the short-side direction.

When viewed in the orthogonal direction, a dimension of the second heat conductive direction 46 in the longitudinal direction is equal to or less than twice a dimension of a contact portion of the second opposite surface 46R, in the longitudinal direction, with which the energization interrupting member 60 is in contact. That is, the contact portion between the energization interrupting member 60 and the second opposite surface 46R is a portion on the second opposite surface 46R which is produced by contact of the energization interrupting member 60 with the second opposite surface 46R. By the contact of the energization interrupting member 60 with the second opposite surface 46R, a contact area on the second opposite surface 46R is produced, and the dimension of the contact portion is defined by an outline of the contact area. That is, the dimension of the contact portion in the longitudinal direction is defined by the outline of the contact area in the longitudinal direction. Moreover, a dimension of the second heat conductive member 46 in the short-side direction orthogonal to the orthogonal direction and the longitudinal direction is equal to or less than a dimension of the contact portion of the second opposite surface 46R, in the short-side direction, with which the energization interrupting member 60 is in contact. That is, the dimension of the contact portion in the short-side direction is defined by the outline of the contact area in the short-side direction. It is preferable that the dimension of the second heat conductive member 46 in the short-side direction is greater than the width of one resistance heating element 12 in the short-side direction, and it is preferable that the dimension of the second heat conductive member 46 in the short-side direction is greater than the distance between the adjacent two resistance heating element 12 in the short-side direction.

As illustrated in FIG. 2C, the first thermistor 50A is disposed so as to detect the temperature at positions in a range in which a sheet with a minimum width W2 usable in the heating unit 1 can pass. The second thermistor 50B is disposed so as to detect the temperature at a position in a range in which the sheet with a maximum width W1 usable in the heating unit 1 can pass and out of the range in which the sheet with the minimum width W2 usable in the heating unit 1 can pass (a range located on the other-end side of the minimum width W2 in which the second thermistor 50B can be disposed is illustrated in FIG. 2A as an end range AE1). The energization interrupting member 60 is disposed so as to detect the temperature at a position in the range in which the sheet with the maximum width W1 usable in the heating unit 1 can pass and out of the range in which the sheet with the minimum width W2 usable in the heating unit 1 can pass (a range located on one-end side of the minimum width W2 in which the energization interrupting member 60 can be disposed is illustrated in FIG. 2A as an end range AE2).

Then, one ends 12A and the other ends 12B of the resistance heating elements 12 are located on outer sides of the maximum width W1 and on an inner side of one end portion 38A and the other end portion 38B of the first heat conductive member 30 in the longitudinal direction. That is, a length of the first heat conductive member 30 is longer than a length of the resistance heating element 12 in the longitudinal direction.

The one end portion 38A and the other end portion 38B of the first heat conductive member 30 are located on outer sides of the one ends 12A and the other ends 12B of the resistance heating element 12 and on an inner side of one end 11A and the other end 11B of the substrate 11 in the longitudinal direction. That is, a length of the substrate 11 is longer than the length of the first heat conductive member 30 in the longitudinal direction.

Operations and effects of the above heating unit 1 will be explained.

The thermistor 50 is in contact with the second opposite surface 45R of the second heat conductive member 45, and the energization interrupting member 60 is in contact with the second opposite surface 46R of the second heat conductive member 46. Incidentally, if the thermistor 50 and the energization interrupting member 60 are in contact with the first opposite surface 32 of the first heat conductive member 30 directly, the thermistor 50 and the energization interrupting member 60 may be affected by temperature unevenness due to disposition of the resistance heating elements 12. For example, in a case where the thermistor 50 and the energization interrupting member 60 are in contact with portions each corresponding to a portion located between the adjacent two resistance heating elements 12 in the short-side direction on the first opposite surface 32, it may be difficult to detect an accurate temperature. However, the thermistor 50 and the energization interrupting member 60 are in contact with the second opposite surfaces 45R, 46R of the second heat conductive members 45, 46 without directly being in contact with the first opposite surface 32 of the first heat conductive member 30 in the embodiment; therefore, temperature unevenness due to disposition of the resistance heating elements 12 can be uniformed by the second heat conductive members 45, 46. Accordingly, it is possible to detect the accurate temperature by the thermistor 50 and the energization interrupting member 60.

The end ranges AE1, AE2 are portions in which the temperatures of the end ranges AE1, AE2 are easily increased, since heat is not deprived by the sheet with the minimum width W2 when the sheet with the minimum width W2 is heated. When the temperatures at the end ranges AE1, AE2 are increased, heat of the heater 10 is transmitted through the first heat conductive member 30 and the second heat conductive members 45B, 46 and flows from the end ranges AE1, AE2 to the range inside the minimum width W2. However, since the second heat conductive members 45B, 46 are provided in addition to the first heat conductive member 30 in the embodiment, heat conduction performance at the end ranges AE1, AE2 improves. Accordingly, it is possible to suppress temperature increase at end portions in the longitudinal direction of the heater 10.

Since the length of the first heat conductive member 30 is longer than the length of the resistance heating element 12, it is possible to uniform the temperature of the heater 10 in the entire range in which the resistance heating elements 12 are disposed in the longitudinal direction of the heater 10.

Since the second heat conductive members 45, 46 are configured such that the dimensions of the thermistor 50 and the energization interrupting member 60 in the longitudinal direction and the short-side direction are respectively equal to or less than twice the dimensions of the contact portions of the second heat conductive members 45, 46, in the longitudinal direction and the short-side direction, with which the thermistor 50 and the energization interrupting member 60 are in contact, the second heat conductive members 45, 46 are properly small. Accordingly, it is possible to limit a range in the second heat conductive members 45, 46 where temperatures are to be detected to a predetermined range.

Since the second thermistor 50B is disposed so as to detect the temperature at a position in the end range AE1, it is possible to detect temperature increase in the end range AE1 by the second thermistor 50B.

Since the energization interrupting member 60 is disposed so as to detect the temperature at the position in the end range AE2, it is possible to detect temperature increase in the range AE2 by the energization interrupting member 60.

Since the second heat conductive member 45 is engaged with the protruding portions 53B of the thermistor 50, it is possible to be properly positioned the second heat conductive member 45 with respect to the thermistor 50.

Since the protruding portions 46B of the second heat conductive member 46 are engaged with the energization interrupting member 60, it is possible to be properly positioned the second heat conductive member 46 with respect to the energization interrupting member 60.

The embodiment of the present disclosure has been explained above. The present disclosure is not limited to the above embodiment and can be achieved by being modified suitably.

A method for positioning the second heat conductive member may be different from one in the above embodiment.

Figure 7A:
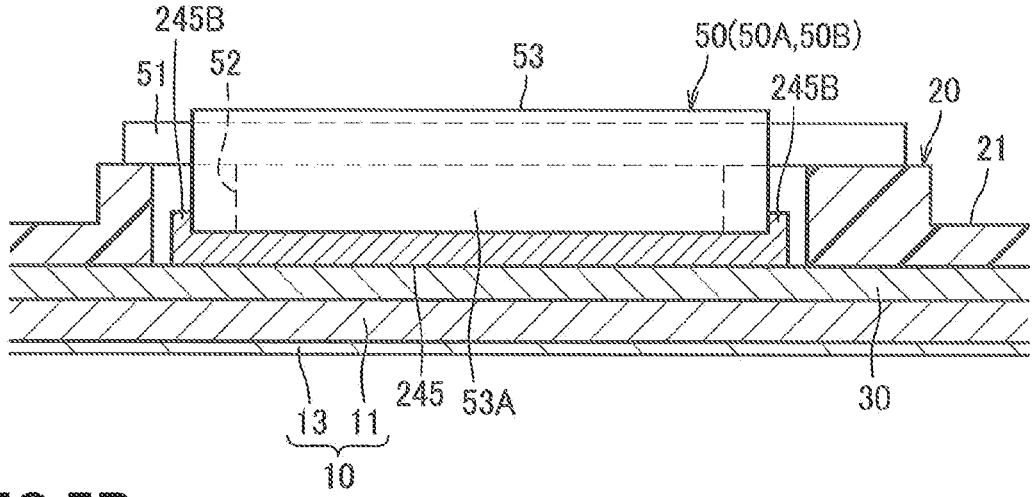
FIG. 7A is a cross-sectional view of a heating unit along the longitudinal direction for explaining another modification of positioning of the second heat conductive member and the thermistor.

For example, instead of the protruding portions of the thermistor 50, a second heat conductive member 245 may have protruding portions 245B, each of which is an example of a second protruding portion, at both ends in the longitudinal direction of the second heat conductive member 245, and the protruding portions 245B may be engaged with both end portions of the film 53 in the thermistor 50 as illustrated in FIG. 7A.

Figure 7B:
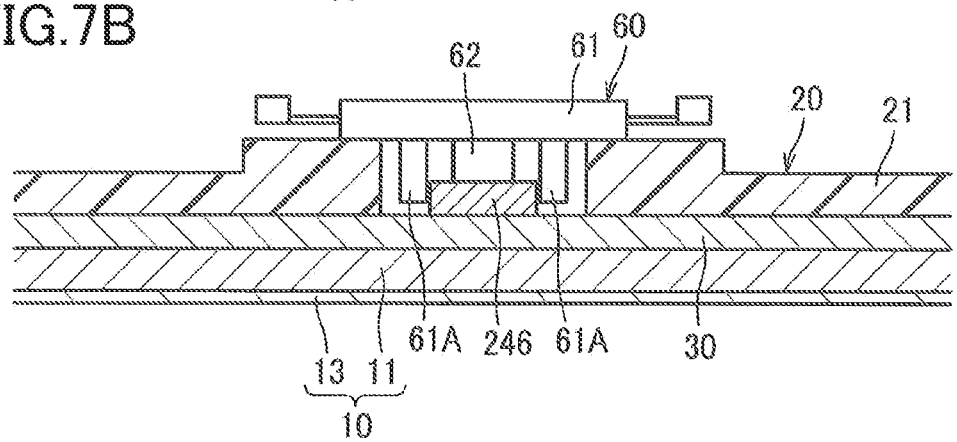
FIG. 7B is a cross-sectional view of a heating unit along the longitudinal direction for explaining another modification of positioning of the second heat conductive member and the energization interrupting member.

Instead of the protruding portions of the second heat conductive member, the energization interrupting member 60 may have protruding portions 61A, which is an example of a first protruding portion, at both ends in the longitudinal direction of the energization interrupting member 60, and the protruding portions 61A may be engaged with both end portions of a second heat conductive member 246 as illustrated in FIG. 7B.

Figure 7C:
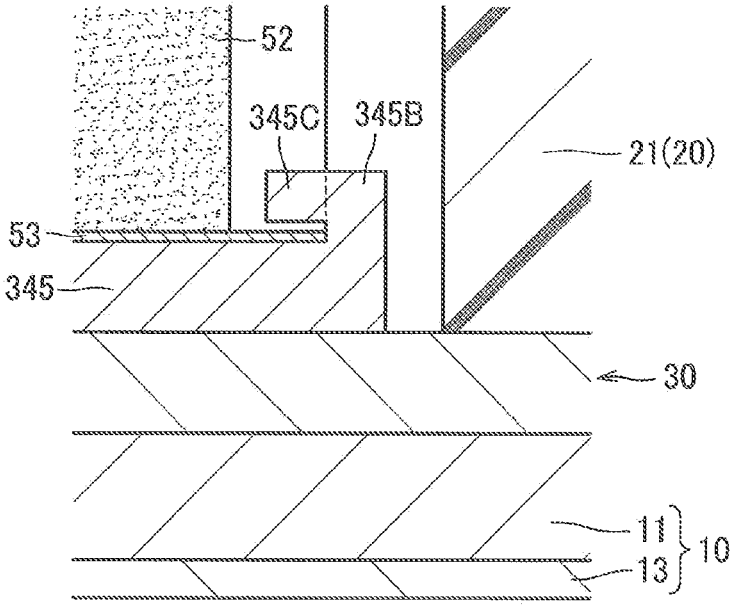
FIG. 7C is an enlarged cross-sectional view of a heating unit along the longitudinal direction for explaining further another modification of the second heat conductive member and the thermistor.

Not only the second heat conductive member 245 has the protruding portions 245B protruding toward the thermistor 50 as in the modification illustrated in FIG. 7A, but also a second heat conductive member 345 may have locking members 345C protruding from protruding portions 345B, each of which is an example of a second protruding portion, toward an inner side in the longitudinal direction in addition to protruding portions 345B protruding toward the thermistor 50 as in a modification illustrated in FIG. 7C. When the locking members 345C are engaged with the film 53, it is possible to prevent the second heat conductive member 345 from coming off unnecessarily after the film 53 is mounted to the second heat conductive member 345.

Figure 8A:
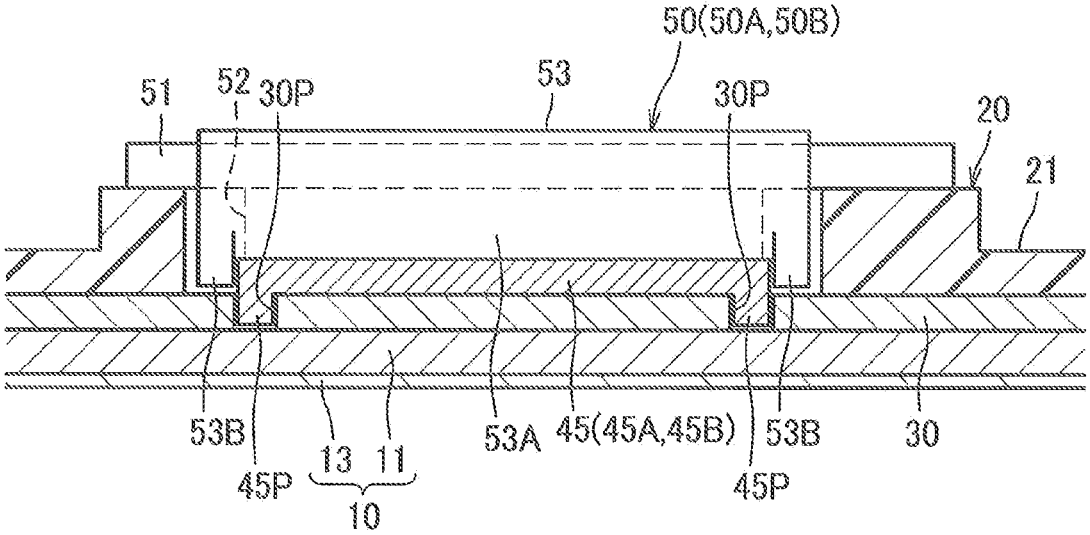
FIG. 8A is a cross-sectional view of an embodiment along the longitudinal direction in which the second heat conductive member is positioned with respect to the first heat conductive member by a protruding portion of the second heat conductive member.
Figure 8B:
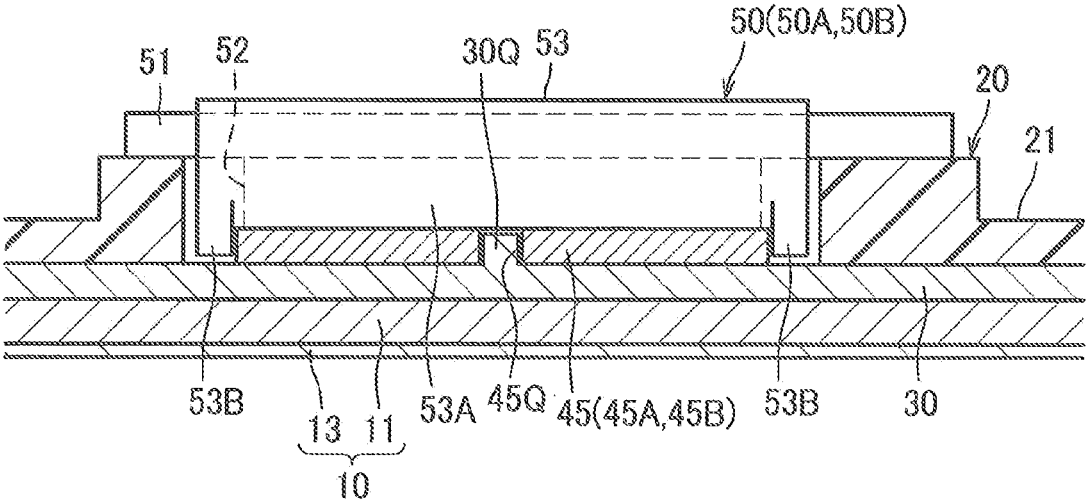
FIG. 8B is a cross-sectional view of an embodiment along the longitudinal direction in which the second heat conductive member is positioned with respect to the first heat conductive member by a protruding portion of the first heat conductive member.

Moreover, the second heat conductive member may include a positioner by which the second heat conductive member is positioned with respect to the first heat conductive member. For example, as illustrated in FIG. 8A, the second heat conductive member 45 may include protruding portions 45P, which is an example of a protrusion, protruding toward the heater 10 side at ends of the second heat conductive member 45 in the longitudinal direction, and the first heat conductive member 30 may include holes 30Q, which is an example of a recess, with which the protruding portions 45P engage. Alternatively, on the contrary, as illustrated in FIG. 8B, the first heat conductive member 30 may include a protruding portion 30Q which is an example of a protrusion, protruding toward a side opposite to the heater 10 side, and the second heat conductive member 45 may include a hole 45Q, which is an example of a recess, with which the protruding portion 30Q engages. According to these configurations, it is possible to position the second heat conductive member 45 with respect to the first heat conductive member 30.

Figure 9A:
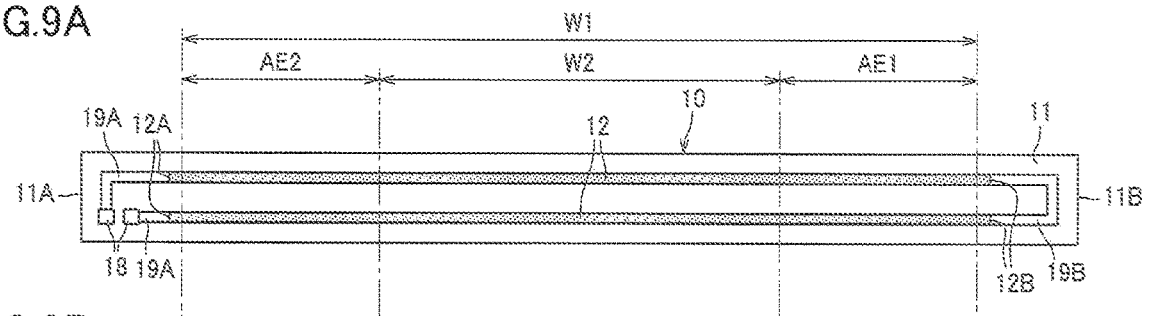
FIG. 9A is a view illustrating a surface on which resistance heating elements of a heater in a modification is disposed.
Figure 9B:
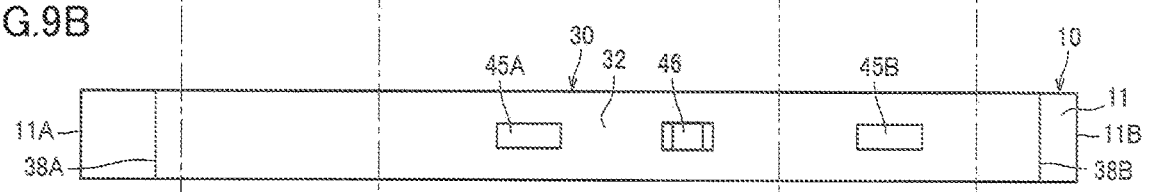
FIG. 9B is a view of the heater, the first heat conductive member and the second heat conductive member viewed from the back side of the heater.
Figure 9C:
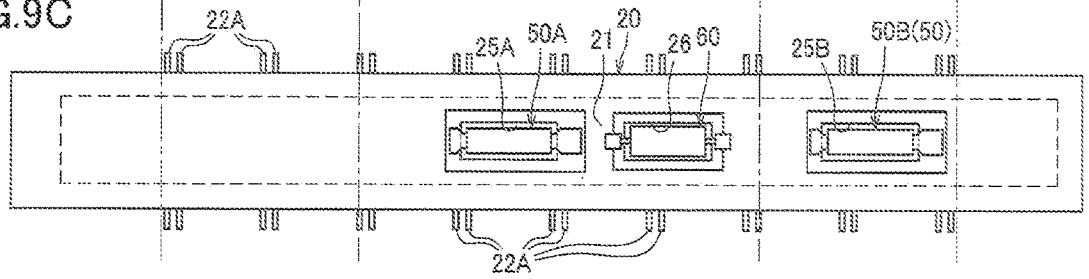
FIG. 9C is a view of the heater and the holder viewed from the side opposite to the heater.

Moreover, the energization interrupting member 60 may be disposed so as to detect the temperature at a position in the range in which the sheet with the minimum width W2 usable in the heating unit 1 can pass as in a modification illustrated in FIG. 9C. Also in this case, it is possible to detect the accurate temperature by the thermistor 50 and the energization interrupting member 60. The energization interrupting member 60 is disposed at the position in the range in which the sheet with the minimum width W2 usable in the heating unit 1 can pass; therefore, it is possible to detect abnormal temperature increase of the heater 10 regardless of the size of the sheet in the width direction.

The numbers of the temperature sensors and the energization interrupting members are not limited. Only one temperature sensor may be provided and three or more temperature sensors may be provided. Two or more energization interrupting members may be provided and it is possible that no energization interrupting member is provided.

In the above embodiment, each of the first heat conductive member 30 and the second heat conductive members 45, 46 is formed of one sheet-like member; however, each of them may be formed of a combination of a plurality of sheet-like members. In this case, the material, heat conductivity, and the shape of the plurality of sheet-like members may be different from one another and may be the same as one another.

In the above embodiment, the substrate 11 of the heater 10 is formed of the long rectangular plate made of ceramic; however, the substrate 11 may be formed of a long rectangular plate made of metal such as stainless steel, which has a heat conductivity lower than that of the heat conductive member 30.

Respective components explained in the above embodiment and modification examples may be arbitrarily combined to achieve the disclosure.

What is claimed is:

1. A heating unit for an image forming apparatus, comprising:

a heater including a substrate and a resistance heating element provided on the substrate;

a temperature sensor configured to detect a temperature of the heater;

an endless belt configured to rotate around the heater;

a holder supporting the heater;

a first heat conductive member located between the heater and the holder, the first heat conductive member including a first heater-side surface, which is in contact with a back surface of the heater, and a first opposite surface located opposite to the first heater-side surface, the first heat conductive member having a heat conductivity that is higher than that of the substrate, the first heat conductive member being a graphite sheet; and a second heat conductive member, which has a sheet shape and which is smaller than the first heat conductive heat member when viewed in an orthogonal direction orthogonal to the first opposite surface, the second heat conductive member including a second heater-side surface, which is in surface contact with the first opposite surface, and a second opposite surface located opposite to the second heater-side surface and parallel with respect to the second heat-side surface, the second heat conductive member having a heat conductivity higher than that of the substrate, the second conductive heat member being made of aluminum or an aluminum alloy, and wherein the temperature sensor is in surface contact with the second opposite surface of the second heat conductive member.

2. The heating unit for an image forming apparatus according to claim 1, wherein a length of the first heat conductive member in a longitudinal direction of the heater is longer than a length of the resistance heating element.

3. The heating unit for an image forming apparatus according to claim 1, wherein, when viewed in the orthogonal direction orthogonal to the first opposite surface, a dimension of the second heat conductive member in a longitudinal direction of the heater is equal to or less than twice a dimension of a contact portion of the second opposite surface in the longitudinal direction, the contact portion being a portion of the second opposite surface with which the temperature sensor is in contact, and wherein, when viewed in the orthogonal direction, a dimension of the second heat conductive member in a short-side direction orthogonal to the orthogonal direction and the longitudinal direction is equal to or less than twice a dimension of the contact portion of the second opposite surface in the short-side direction.

4. The heating unit for an image forming apparatus according to claim 1, wherein the temperature sensor is configured to detect the temperature at a position, in the longitudinal direction of the heater, in a range in which a recording medium with a maximum width usable in the heating unit passes and out of a range in which a recording medium with a minimum width usable in the heating unit passes.

5. The heating unit for an image forming apparatus according to claim 1, wherein the temperature sensor is configured to detect the temperature at a position, in the longitudinal direction of the heater, in a range in which a recording medium with a minimum width usable in the heating unit passes.

6. The heating unit for an image forming apparatus according to claim 1, wherein the first heat conductive member is an anisotropic heat conductive member in which a heat conductivity in a direction parallel to the first heater-side surface is higher than a heat conductivity in a direction orthogonal to the first heater-side surface.

7. The heating unit for an image forming apparatus according to claim 1, wherein the temperature sensor includes a first protruding portion, and wherein the second heat conductive member is positioned with respect to the temperature sensor by engaging with the first protruding portion.

8. The heating unit for an image forming apparatus according to claim 1, wherein the second heat conductive member includes a second protruding portion, and wherein the second protruding portion engages with the temperature sensor.

9. The heating unit for an image forming apparatus according to claim 1, wherein a first member, which is one of the first heat conductive member and the second heat conductive member, includes a protrusion, and a second member, which is the other one of the first heat conductive member and the second heat conductive member, includes a recess with which the protrusion engages.

10. The heating unit for an image forming apparatus according to claim 1, wherein the temperature sensor is a thermistor, or a thermostat configured to interrupt energization to the resistance heating element when the heater is abnormally increased in temperature.

11. A heating unit for an image forming apparatus, comprising: a heater including a substrate and two resistance heating elements provided on the substrate; a temperature sensor configured to detect a temperature of the heater; an endless belt configured to rotate around the heater; a holder supporting the heater; a first heat conductive member located between the heater and the holder, the first heat conductive member including a first heater-side surface, which is in contact with a back surface of the heater and a first opposite surface located opposite to the first heater-side surface, the first heat conductive member having a heat conductivity that is higher than that of the substrate; and a second heat conductive member, which has a sheet shape and which is smaller than the first heat conductive heat member when viewed in an orthogonal direction orthogonal to the first opposite surface, the second heat conductive member including a second heater-side surface, which is in surface contact with the first opposite surface, and a second opposite surface located opposite to the second heater-side surface and parallel with respect to the second heat side surface, the second heat conductive member having a heat conductivity higher than that of the substrate, wherein the temperature sensor is in contact with the second opposite surface of the second heat conductive member, wherein, when viewed in the orthogonal direction, a dimension of the first heat conductive member in a short-side direction orthogonal to the orthogonal direction and a longitudinal direction of the heater is larger than a range in the short-side direction in which the two resistance heating elements are disposed, and wherein, when viewed in the orthogonal direction, the second heat conductive member is located between the two resistance heating elements in the short-side direction.

12. The heating unit for an image forming apparatus according to claim 11, wherein a length of the first heat conductive member in the longitudinal direction of the heater is longer than a length of the resistance heating element.

13. The heating unit for an image forming apparatus according to claim 11, wherein, when viewed in the orthogonal direction, a dimension of the second heat conductive member in the longitudinal direction of the heater is equal to or less than twice a dimension of a contact portion of the second opposite surface in the longitudinal direction, the contact portion being a portion of the second opposite surface with which the temperature sensor is in contact, and wherein, when viewed in the orthogonal direction, a dimension of the second heat conductive member in the short-side direction is equal to or less than twice a dimension of the contact portion of the second opposite surface in the short-side direction.

14. The heating unit for an image forming apparatus according to claim 11, wherein the temperature sensor is configured to detect the temperature at a position, in the longitudinal direction of the heater, in a range in which a recording medium with a maximum width usable in the heating unit passes and out of a range in which a recording medium with a minimum width usable in the heating unit passes.

15. A heating unit for an image forming apparatus, comprising:

a heater including a substrate and a resistance heating element provided on the substrate;

a temperature sensor configured to detect a temperature of the heater;

an endless belt configured to rotate around the heater;

a holder supporting the heater;

a first heat conductive member located between the heater and the holder, the first heat conductive member including a first heater-side surface, which is in contact with a back surface of the heater and a first opposite surface located opposite to the first heater-side surface, the first heat conductive member having a heat conductivity that is higher than that of the substrate; and a second heat conductive member which has a sheet shape and which is smaller than the first heat conductive heat member when viewed in an orthogonal direction orthogonal to the first opposite surface, the second heat conductive member including a second heater-side surface, which is in surface contact with the first opposite surface, and a second opposite surface located opposite to the second heater-side surface and parallel with respect to the second heat side surface, the second heat conductive member having a heat conductivity higher than that of the substrate, wherein the temperature sensor is in contact with the second opposite surface of the second heat conductive member, and wherein the temperature sensor includes a temperature detecting element and a film which is disposed between the temperature detecting element and the second heat conductive member.

16. The heating unit for an image forming apparatus according to claim 15, wherein a length of the first heat conductive member in a longitudinal direction of the heater is longer than a length of the resistance heating element.

17. The heating unit for an image forming apparatus according to claim 15, wherein, when viewed in the orthogonal direction, a dimension of the second heat conductive member in the longitudinal direction of the heater is equal to or less than twice a dimension of a contact portion of the second opposite surface in the longitudinal direction, the contact portion being a portion of the second opposite surface with which the temperature sensor is in contact, and wherein, when viewed in the orthogonal direction, a dimension of the second heat conductive member in a short-side direction orthogonal to the orthogonal direction and the longitudinal direction is equal to or less than twice a dimension of the contact portion of the second opposite surface in the short-side direction.

18. The heating unit for an image forming apparatus according to claim 15, wherein the temperature sensor is configured to detect the temperature at a position, in the longitudinal direction of the heater, in a range in which a recording medium with a maximum width usable in the heating unit passes and out of a range in which a recording medium with a minimum width usable in the heating unit passes.

* * * * *